US007918990B2

(12) United States Patent
Seyfried et al.

(10) Patent No.: US 7,918,990 B2
(45) Date of Patent: Apr. 5, 2011

(54) FUEL PRESENTING REDUCED AROMATICS LEVELS AND A HIGH OCTANE NUMBER

(76) Inventors: Luc Seyfried, Ecrainville (FR); Claude Marty, Le Havre (FR)

( * ) Notice: Subject to any disclaimer, the term of this patent is extended or adjusted under 35 U.S.C. 154(b) by 1354 days.

(21) Appl. No.: 10/550,702

(22) PCT Filed: Mar. 27, 2003

(86) PCT No.: PCT/FR03/00966

§ 371 (c)(1),
(2), (4) Date: Sep. 26, 2005

(87) PCT Pub. No.: WO2004/094571

PCT Pub. Date: Nov. 4, 2004

(65) Prior Publication Data

US 2006/0288635 A1 Dec. 28, 2006

(51) Int. Cl.
*C10L 1/06* (2006.01)
*C10L 1/16* (2006.01)

(52) U.S. Cl. ..... 208/15; 44/300; 585/14

(58) Field of Classification Search ..... 208/18, 208/17, 19, 15; 44/300; 585/14
See application file for complete search history.

(56) References Cited

U.S. PATENT DOCUMENTS

| | | | | |
|---|---|---|---|---|
| 2,407,717 | A * | 9/1946 | Marschner | 585/14 |
| 2,409,156 | A | 10/1946 | Alden et al. | |
| 3,106,194 | A * | 10/1963 | Cantwell, Jr. et al. | 123/1 A |
| 3,224,848 | A * | 12/1965 | Henderson | 44/448 |
| 3,644,196 | A | 2/1972 | Lawson | |
| 6,183,703 | B1 * | 2/2001 | Hsu et al. | 422/211 |
| 6,207,040 | B1 | 3/2001 | Amadei | |
| 6,451,075 | B1 * | 9/2002 | Schoppe et al. | 44/454 |

FOREIGN PATENT DOCUMENTS

| | | |
|---|---|---|
| AU | 2003251025 | 11/2004 |
| CA | 2520077 | 11/2004 |
| EP | 0337026 | 10/1989 |
| EP | 1611224 | 1/2006 |
| FR | 2830259 | 4/2003 |
| WO | WO 2004/094571 | 11/2004 |

OTHER PUBLICATIONS

Demirel, Belma et al., Thermodynamic probability of the conversion of multiring aromatics to isoparaffins and cycloparaffins, Fuel Processing Technology, Elsevier, 1998, 55, 83-84.*
Warnatz et al., Combustion: Physical and Chemical Fundamentals, Modeling and Simulation, Experiments, Pollutant Formation , 2001, Springer, 3rd ed., p. 228.*
International Search Report for PCT/FR2003/000966, Dec. 16, 2003 (mailing date), Totalfinaelf France.
English Translation of International Search Report for PCT/FR2003/000966, Dec. 16, 2003 (mailing date), Totalfinaelf France.
International Preliminary Examination Report for PCT/FR2003/000966, Jul. 15, 2005 (mailing date), Totalfinaelf France.
English Translation of International Preliminary Examination Report for PCT/FR2003/000966, Jul. 15, 2005 (mailing date), Totalfinaelf France.

* cited by examiner

*Primary Examiner* — Walter D Griffin
*Assistant Examiner* — Renee Robinson
(74) *Attorney, Agent, or Firm* — Adeli & Tollen LLP

(57) ABSTRACT

The invention relates to a fuel containing at least 5 vol. %, and preferably at least 10 vol. %, of a hydrocarbon base (B3) consisting essentially of cycloparaffins comprising between 6 and 8 carbon atoms. The ratio R of the quantities by volume (B1+B2)/B3 is higher than 2 and preferably between 2.3 and 19.

27 Claims, No Drawings

FUEL PRESENTING REDUCED AROMATICS LEVELS AND A HIGH OCTANE NUMBER

CROSS REFERENCE TO RELATED APPLICATIONS

This patent application claims benefit to International Application PCT/FR2003/000966, filed on Mar. 27, 2003, now published as International Publication WO 2004/094571.

The present invention relates to novel formulations of fuels having a high octane number and having reduced levels of aromatic compounds, in particular benzene, which can be used to feed internal combustion and spark ignition engines and, in particular, reciprocating engines fitted in aircraft.

It is known that, before they are placed on the market, fuels intended to feed internal combustion and spark ignition engines must satisfy precise physico-chemical characteristics, in order to guarantee to the consumer a high level of mechanical performance and, at the same time, minimize sources of pollution, whether these are created by exhaust gases or by the product itself during its handling or storage. These characteristics, which can vary appreciably from one fuel to another, must nevertheless remain within a range defined by official specifications gathered and issued by recognized bodies, such as AFNOR in France or ASTM in the United States. Among these specifications, the octane number or, more precisely, the number measuring the anti-knock value of a fuel compared with a so-called reference gasoline, is an essential characteristic, as it reflects the combustion performance of the fuel in the cylinders of the engine and, in particular, its resistance to pinking, i.e. its resistance to uncontrolled mass self-ignition of the fuel. This phenomenon, which is well known to persons skilled in the art can, if it is not controlled, have harmful consequences on the service life of the engine, such as premature fatigue and wear of the essential parts of the mechanical drive assembly.

This is why, for motor vehicles, a distinction is drawn between two types of octane number for fuels intended to feed engines fitting these vehicles, namely the RON (Research Octane Number) and the MON (Motor Octane Number), called F1 and F2 respectively in the professional circles.

In the field of aviation and, more precisely, for aircraft equipped with spark ignition engines, the fuels offered on the market must be developed with care and must, in particular, have a very good resistance to pinking, taking into account the severe and specific conditions of use of these engines, in particular on take-off, and also the obvious reasons of reliability and safety of operation at altitude. Here also, two specific octane numbers have consequently been defined and integrated into the specifications of aircraft-grade gasoline, namely:

- a number, also called MON or motor octane number, which replaces the previous directly correlated number, formerly called F3 in the professional circles, aiming to assess a correct operation of the drive assembly in normal operation, i.e. at steady speed and altitude;
- and the so-called supercharge octane number, also called F4 or performance number, reflecting the combustion performance requirements of the engine on take-off.

A fuel, the commonly used trade name of which is "AVGAS 100 LL", corresponds to a gasoline for internal combustion and spark ignition aircraft engines, the MON of which must, according to the standard ASTM D910-00, be greater than or equal to 99.5 and the F4 greater than or equal to 130. The abbreviation "LL" stands for "Low Lead", i.e. that the lead content of the fuel, generally originating from alkyllead compounds, must, according to this standard, which is in force today, be less than or equal to 0.56 gram per litre of gasoline.

It is this type of aircraft fuel that will be more particularly referred to in the remainder of the present description, but the fuels according to the invention can be used in fields other than aviation, for example for engines of competition or similar vehicles, i.e. for engines requiring fuels with a very high octane number. The fuel which is a subject of the present invention can also be used to feed systems of very diverse types, for example, a fuel treatment unit, such as a reformer, coupled to a fuel cell.

It is known that gasolines produced directly by distillation of crude oil do not have the required characteristics and, in particular, octane numbers sufficient for their direct placement on the aviation market. The refiner must therefore, at their production stage, carry out a mixing of several compounds, preferably hydrocarbon, in order to obtain products which, with the optional addition of additives, comply with the different specifications required. These compounds and additives can be constituted, for example and non-limitatively:

- by hydrocarbons containing mainly aromatic compounds presenting naturally, high octane numbers;
- by from the alkylation of gases-originating hydrocarbons, containing 1 to 4 carbon atoms and free from aromatic or olefinic molecules;
- by light gasolines originating from the direct distillation of crude oil, whether these are isomerized or non-isomerized;
- by distillation light ends such as butanes or isopentanes;
- by oxygenated or organometallic compounds, the chemical composition of which is specifically chosen to obtain particular properties during the combustion cycle of the fuel in the engine.

The aromatic hydrocarbons involved in the composition of a gasoline generally originate from a production process, called "reforming" of gasolines, available in particular in an oil refinery. This process, sometimes used by the operator under conditions of high severity, in direct relation with the quality requirements of the products produced, in particular for gasolines intended for aircraft engines, allows, thanks to a set of chemical reactions taking place at high temperature, under high pressure and necessarily in the presence of an appropriate catalyst, the conversion of molecules with straight or cyclic chains contained in the heaviest gasolines, produced by direct distillation of crude oil, to more stable branched and cyclic aromatic hydrocarbons. These aromatic hydrocarbons are generally called "reformates" in the trade and have a high octane number.

However, the presence of such reformates in significant quantities in fuels, which can reach several tens of % by volume, poses a real problem, due to the aromatic molecules that they contain. It is known that the presence of aromatic hydrocarbons and, in particular, benzene in a fuel runs counter to the trend of current legislation and most certainly of future legislation, as regards environmental matters. In fact, faced with the problems linked to the health of consumers, in particular those raised by the emissions resulting from the different sources of fossil energy in living spaces, and more precisely by fuels, the majority of these legislations advocate a reduction in the levels of fuels in aromatic compounds and in particular in benzene, as this last molecule is deemed to be carcinogenic for humans.

Formulations of fuels having both a sufficiently high octane number, in accordance with the standard ASTM D910-00, to be used, for example, in spark-ignition aircraft engines, and a reduced aromatics content, without the addition of specific additives which are octane donors are not found in the sector.

Thus, for example, JP 05179264 proposes a fuel formulated with bases available as standard in an oil refinery, to which substantial quantities of naphthenes and MTBE have been added. Different processes, of greater or lesser complexity, have been proposed for reducing the benzene level of the fuels such as, for example, in FR A-2 686 094 or FR-A-2 686 095, which use a standard hydrogenation of the benzene contained in a hydrocarbons base which are part of the constitution of the fuel, followed by an operation of isomerization of the molecules thus formed.

All the processes proposed today for reducing the level of aromatic hydrocarbons and, more particularly, of benzene in gasolines pose technical difficulties for refiners, while generating additional costs through the necessary use of novel and numerous process stages in the gasoline production lines.

The refiner is therefore confronted with a double problem in order to economically produce, from hydrocarbons cuts available in an oil refinery, fuels for aircraft engines which have low levels of aromatic compounds and, in particular, benzene, but have octane numbers high enough to comply with the standards in force, thus:

- either to formulate fuels with small quantities of aromatic hydrocarbons but to the detriment of the octane number, this octane deficit then having to be compensated for by the addition of additives, involving an additional cost for the refiner; moreover, it is becoming more and more difficult to use specific additives, as the current trend is to minimize, even eliminate, additives which are not compatible with the environment, such as organic derivatives of lead, which are good octane suppliers but also significant sources of pollution for humans,
- or to subject the different hydrocarbons cuts involved in the composition of this fuel to treatments, in such a way so as to meet the specifications for aircraft gasolines; these different treatments use complex processes, however, and therefore generate a significant additional cost for the refiner and can cause production restrictions, linked to the different constraints inherent in each of the processes used.

The use, in an aviation fuel, of a mixture of hydrocarbons comprising spiropentane, i.e. a hydrocarbon of the cycloparaffinic type with 5 carbon atoms, of formula $C_5H_8$, is known from U.S. Pat. No. 2,411,582.

Research carried out by the Applicant in the field of the formulation of fuels has now allowed him to establish that the replacement, in gasolines for internal combustion and spark ignition engines and, in particular, for aircraft engines, i.e. in fuels specifically requiring a very high octane number, of a substantial quantity of the reformate by hydrocarbons having saturated rings containing 6 to 8 carbon atoms, also called cycloparaffins, cycloalkanes or naphthenes, while still complying with the specifications in force, makes it possible to give them a high type F4 octane number, at least equal to 130, and, as a result, considerably reduce the level of aromatic hydrocarbons, and in particular benzene, of these fuels.

Therefore an aim of the invention is to propose novel formulations of fuels for internal combustion and spark ignition engines which contain a particularly reduced quantity of aromatic hydrocarbons compared with the formulations of the prior art, and in which cycloparaffins containing 6 to 8 carbon atoms are present which give this fuel, used in particular in spark-ignition aircraft engines, an octane number and characteristics which comply with the standard in force.

To this end, a subject of the invention is a novel fuel for feeding spark ignition engines and in particular those fitted in aircraft, having an F4 octane number at least equal to 130 and a reduced level of aromatic compounds, containing substantial quantities of a first hydrocarbons base (B1), essentially constituted by isoparaffins comprising 6 to 9 carbon atoms, and a second hydrocarbons base (B2) also constituted by isoparaffins comprising 4 or 5 carbon atoms and, optionally, other hydrocarbons and additives customary for this type of fuel, in a quantity and quality sufficient for the fuel to comply with the specifications in force, characterized in that it contains at least 5.0% by volume, and preferably at least 10.0% by volume, of a hydrocarbons base (B3) essentially composed of cycloparaffins comprising 6 to 8 carbon atoms, and in that the ratio R of the quantities by volume (B1+B2)/B3 is greater than 2.0 and preferably comprised between 2.3 and 19.0.

The level of aromatic hydrocarbons in the fuel according to the invention is less than 10% by volume and preferably less than 5% by volume, measured by the FIA method according to the standard ASTM D1319, and the level of benzene is less than 0.2% by volume and preferably less than 0.1% by volume, measured by the infrared spectrometry method according to the standard NF EN 238.

The determination of the levels of other possible usual hydrocarbons and additives in the fuel, with a view to making them comply with the regulations in force in the sector or with specific characteristics, is within the competence of a person skilled in the art and poses no particular technical problem.

The use, in the fuel according to the invention, of cycloparaffinic hydrocarbons containing 6 to 8 carbon atoms proves to be particularly advantageous in economic terms, for the following reasons:

- it offers a useful outlet for compounds which do not currently have a particular practical application, without an expensive conversion treatment;
- it makes it possible to avoid carrying out a decyclization of these compounds, carried out for the sole reason that they are precursors of aromatic compounds and in particular of benzene, which can present well-known risks, both for humans and animals;
- it leads to a fuel which complies with existing specifications and does not have the drawbacks of the usual fuels intended for the same applications, at a cost which is generally lower than for the latter.

Other characteristics and advantages of the invention can be seen in the detailed example which follows, which is non-limitative.

EXAMPLE

Six series of four fuels and one series of three fuels of Avgas100LL type, intended to feed spark ignition aircraft engines, were formulated by the Applicant, according to the invention. These fuels are respectively designated C1 to C4 and C5 to C8 in Table 1, C9 to C12 and C13 to C16 in Table 2, C17 to C20 and C21 to C24 in Table 3, C25 to C27 in Table 4.

TABLE 1

Formulations of fuels according to the invention and their characteristics (Fuels 1 to 9)

| | Fuels | | | | | | | | | ASTM D-910-00 |
|---|---|---|---|---|---|---|---|---|---|---|
| | C1 | C2 | C3 | C4 | C5 | C6 | C7 | C8 | C9 | specifications |
| Base B1 (% by vol.) | 91.8 | 77.1 | 79.1 | 54.8 | 86.8 | 83.7 | 71.6 | 50.1 | 81.4 | — |
| Base B2 (% by vol.) | 8.1 | 16.8 | 9.2 | 20.0 | 8.2 | 8.1 | 17.1 | 20.2 | 8.6 | — |
| Base B3 (% by vol.) | 0.0 | 0.0 | 0.0 | 0.0 | 5.0 | 5.0 | 5.0 | 5.0 | 10.0 | — |
| Base B4 (% by vol.) | 0.0 | 6.1 | 11.8 | 25.3 | 0.0 | 3.2 | 6.3 | 24.7 | 0.0 | |
| $R = \frac{B1 + B2}{B3}$ | — | — | — | — | 19.0 | 18.3 | 17.7 | 14.0 | 9.0 | — |
| K = B1/B2 | 11.3 | 4.6 | 8.6 | 2.7 | 10.6 | 10.3 | 4.2 | 2.5 | 9.5 | — |
| F4 ASTM D909 | 129.0 | 130.0 | 138.3 | 142.5 | 130.2 | 132.6 | 130.0 | 142.0 | 130.0 | Min. 130.0 |
| MON ASTM D2700 | 109.9 | 109.1 | 107.7 | 105.5 | 108.3 | 107.7 | 107.4 | 104.0 | 106.6 | Min. 99.5 |
| NHC MJ/Kg ASTM D4529 | 44.4 | 44.2 | 44.0 | 43.6 | 44.4 | 44.2 | 44.2 | 44.0 | 44.3 | Min. 43.5 |
| VP (38° C., KPa) ASTM D5191 | 39.3 | 49.0 | 38.0 | 49.0 | 39.2 | 38.0 | 49.0 | 37.8 | 39.0 | Min. 38.0 |
| 10% Dist. ° C. ASTM D86 | 76 | 74 | 75 | 74 | 75 | 74 | 74 | 73 | 74 | Max. 75 |
| 50% Dist. ° C. ASTM D86 | 92 | 98 | 94 | 100 | 91 | 93 | 100 | 108 | 89 | Max. 105 |
| 90% Dist. ° C. ASTM D86 | 125 | 129 | 125 | 115 | 124 | 128 | 130 | 135 | 120 | Max. 135 |
| Pb g/l ASTM D2392 | 0.56 | 0.56 | 0.56 | 0.56 | 0.56 | 0.56 | 0.56 | 0.56 | 0.56 | Max. 0.56 |
| Density 15° C. ($kg/m^3$) ASTM D4052 | 692.2 | 696.3 | 711.3 | 725.7 | 695.0 | 704.5 | 705.2 | 707.7 | 697.3 | — |
| Aromat. (% by vol..) ASTM D1319 | <5.0 | 5.2 | 10.1 | 21.7 | <5.0 | <5.0 | 5.4 | 21.2 | <5.0 | — |
| Benzene (% by vol.) NF EN 238 | <0.1 | 0.2 | 0.3 | 0.7 | <0.1 | 0.1 | 0.2 | 0.7 | <0.1 | — |

NHC: Net Heat of Combustion
VP: Vapour Pressure

TABLE 2

Formulations of fuels according to the invention and their characteristics (Fuels 10 to 18)

| | Fuels | | | | | | | | | ASTM D-910-00 |
|---|---|---|---|---|---|---|---|---|---|---|
| | C10 | C11 | C12 | C13 | C14 | C15 | C16 | C17 | C18 | specifications |
| Base B1 (% by vol.) | 66.1 | 56.5 | 47.1 | 76.8 | 60.6 | 53.5 | 44.1 | 71.5 | 55.1 | — |
| Base B2 (% by vol.) | 17.5 | 11.5 | 20.2 | 8.2 | 17.8 | 11.5 | 20.2 | 8.5 | 18.2 | — |
| Base B3 (% by vol.) | 10.0 | 10.0 | 10.0 | 15.0 | 15.0 | 15.0 | 15.0 | 20.0 | 20.0 | — |
| Base B4 (% by vol.) | 6.4 | 21.9 | 22.7 | 0.0 | 6.6 | 19.9 | 20.7 | 0.0 | 6.7 | |
| $R = \frac{B1 + B2}{B3}$ | 8.4 | 6.8 | 6.7 | 5.7 | 5.2 | 4.3 | 4.3 | 4.0 | 3.7 | — |
| K = B1/B2 | 3.8 | 4.9 | 2.3 | 9.4 | 3.4 | 4.6 | 2.2 | 8.4 | 3.0 | — |
| F4 ASTM D909 | 130.0 | 144.7 | 140.6 | 130.3 | 130.0 | 143.3 | 139.2 | 130.2 | 130.0 | Min. 130.0 |
| MON ASTM D2700 | 105.8 | 102.5 | 102.7 | 105.0 | 104.1 | 101.3 | 101.5 | 103.3 | 102.4 | Min. 99.5 |
| NHC MJ/Kg ASTM D4529 | 44.1 | 43.5 | 43.5 | 44.2 | 44.0 | 43.5 | 43.5 | 44.1 | 43.9 | Min. 43.5 |
| VP (38° C., KPa) ASTM D5191 | 49.0 | 38.0 | 49.0 | 38.0 | 49.0 | 38.0 | 49.0 | 38.0 | 49.0 | Min. 38.0 |

TABLE 2-continued

Formulations of fuels according to the invention and their characteristics (Fuels 10 to 18)

| | Fuels | | | | | | | | | ASTM D-910-00 |
|---|---|---|---|---|---|---|---|---|---|---|
| | C10 | C11 | C12 | C13 | C14 | C15 | C16 | C17 | C18 | specifications |
| 10% Dist. ° C. ASTM D86 | 73 | 74 | 75 | 74 | 74 | 75 | 75 | 74 | 74 | Max. 75 |
| 50% Dist. ° C. ASTM D86 | 92 | 100 | 105 | 88 | 91 | 103 | 104 | 87 | 92 | Max. 105 |
| 90% Dist ° C. ASTM D86 | 122 | 130 | 134 | 115 | 119 | 127 | 127 | 105 | 124 | Max. 135 |
| Pb g/l ASTM D2392 | 0.56 | 0.56 | 0.56 | 0.56 | 0.56 | 0.56 | 0.56 | 0.56 | 0.56 | Max. 0.56 |
| Density 15° C. (kg/m$^3$) ASTM D4052 | 701.4 | 731.6 | 726.4 | 700.2 | 703.9 | 730.8 | 725.6 | 702.5 | 706.5 | — |
| Aromat. (% by vol..) ASTM D1319 | 5.5 | 18.8 | 19.5 | <5.0 | 5.7 | 17.1 | 17.8 | <5.0 | 5.7 | — |
| Benzene (% by vol.) NF EN 238 | 0.2 | 0.6 | 0.6 | <0.1 | 0.2 | 0.5 | 0.5 | <0.1 | 0.2 | — |

NHC: Net Heat of Combustion
VP: Vapour Pressure

TABLE 3

Formulations of fuels according to the invention and their characteristics (Fuels 19 to 27).

| | Fuels | | | | | | | | | ASTM D-910-00 |
|---|---|---|---|---|---|---|---|---|---|---|
| | C19 | C20 | C21 | C22 | C23 | C24 | C25 | C26 | 27 | specifications |
| Base R1 (% by vol.) | 41.1 | 50.0 | 66.1 | 49.5 | 55.6 | 44.9 | 60.8 | 60.6 | 60.1 | — |
| Base B2 (% by vol.) | 20.2 | 12.0 | 8.9 | 18.6 | 10.3 | 19.2 | 9.2 | 9.2 | 9.6 | — |
| Base B3 (% by vol.) | 20.0 | 20.0 | 25.0 | 25.0 | 25.0 | 25.0 | 30.0 | 30.0 | 30.0 | — |
| Base B4 (% by vol.) | 18.7 | 18.0 | 0.0 | 6.9 | 9.1 | 10.9 | 0.0 | 0.2 | 0.3 | |
| $R = \frac{B1 + B2}{B3}$ | 3.1 | 3.1 | 3.0 | 2.7 | 2.6 | 2.5 | 2.3 | 2.3 | 2.3 | — |
| K = B1/B2 | 2.0 | 4.1 | 7.4 | 2.7 | 5.4 | 2.3 | 6.6 | 6.6 | 6.3 | — |
| F4 ASTM D909 | 137.8 | 141.7 | 130.1 | 130.0 | 136.0 | 132.6 | 130.0 | 130.1 | 130.0 | Min. 130.0 |
| MON ASTM D2700 | 100.2 | 100.0 | 100.7 | 100.7 | 100.0 | 100.0 | 100.0 | 100.0 | 100.0 | Min. 99.5 |
| NHC MJ/Kg ASTM D4529 | 43.5 | 43.5 | 44.1 | 43.9 | 43.7 | 43.7 | 44.0 | 44.0 | 44.0 | Min. 43.5 |
| VP (38° C., KPa) ASTM D5191 | 49.0 | 38.6 | 38.0 | 49.0 | 38.0 | 49.0 | 38.0 | 38.0 | 38.5 | Min. 38.0 |
| 10% Dist. ° C. ASTM D86 | 75 | 75 | 73 | 74 | 74 | 75 | 73 | 74 | 74 | Max. 75 |
| 50% Dist. ° C. ASTM D86 | 109 | 103 | 86 | 88 | 92 | 95 | 86 | 91 | 92 | Max. 105 |
| 90% Dist ° C. ASTM D86 | 131 | 130 | 98 | 109 | 122 | 125 | 97 | 107 | 106 | Max. 135 |
| Pb g/l ASTM D2392 | 0.56 | 0.56 | 0.56 | 0.56 | 0.56 | 0.56 | 0.56 | 0.56 | 0.56 | Max. 0.56 |
| Density 15° C. (kg/m$^3$) ASTM D4052 | 724.9 | 729.8 | 704.8 | 709.1 | 718.8 | 715.3 | 707.2 | 707.5 | 707.4 | — |
| Aromat. (% by vol..) ASTM D1319 | 17.4 | 15.5 | <5.0 | 5.9 | 7.8 | 9.4 | <5 | <5 | <5 | — |
| Benzene (% by vol.) NF EN 23 | 0.5 | 0.5 | <0.1 | 0.2 | 0.2 | 0.3 | <0.1 | <0.1 | <0.1 | — |

NHC: Net Heat of Combustion
VP: Vapour Pressure

The bases, or hydrocarbons cuts of oil origin, used for the production of the fuels according to the invention (C1 to C27) are those commonly used for the production of this type of fuel, with the exception of the cycloparaffinic hydrocarbons cut, containing 6 to 8 carbon atoms.

The first base used (designated Base B1 in Tables 1 to 4), is essentially constituted by isoparaffins containing 6 to 9 carbon atoms. These isoparaffinic hydrocarbons are preferably isooctanes, the preferred quantity of which present in said cut is greater than 70% by mass and, still more preferably, greater than 75% by mass.

Such a hydrocarbons base can originate from different crude oil treatment processes generally found in an oil refinery. In particular, this isooctane-rich hydrocarbons cut, also called "alkylate" in the trade, can be produced, for example, by the process of alkylation of the isobutane by light olefins.

An alternative consists of replacing part of this isoparaffinic cut, and at the same time reducing the proportion of alkylate which is an oil base, the production cost of which is relatively high, with a hydrocarbons cut originating from a light gasolines isomerization unit, these latter originating from crude oil distillation.

The second hydrocarbons base used for the production of the fuels according to the invention (designated "Base B2" in Tables 1 to 4) also belongs to the family of the paraffinic hydrocarbons and can be, for example, a light base essentially constituted by isoparaffinic molecules comprising between 4 and 5 carbon atoms and preferably 5 carbon atoms.

Such an industrial base contains more than 85% by mass of isopentane and preferably more than 90% by mass.

This light paraffinic base can originate, for example, from a fractionation of the lightest fraction of the distillate produced by the atmospheric distillation of crude oil.

Advantageously, this hydrocarbons cut can be replaced by a cut with a high concentration of a mixture of normal butane and isobutane.

The third base used (designated "Base" B3 in Tables 1 to 4), is a hydrocarbons cut essentially constituted by cycloparaffins containing 6 to 8 carbon atoms. Advantageously, this base is constituted by cyclohexanes, the level of which is greater than 80% by mass and preferably greater than 90% by mass. It can originate from different processes used in a refinery for the treatment of crude oils and, in particular, can be taken when leaving the fractionation unit situated downstream of a light gasoline isomerization process.

According to the invention, for certain of these formulations the Applicant introduced a fourth base (designated "Base B4" in Tables 1 to 4), essentially constituted by aromatic hydrocarbons normally used in the formulation of this type of fuel. This hydrocarbons cut containing 6 to 8 carbon atoms, the aromatic compounds level of which is greater than 75% by mass, and preferably greater than 80% by mass, originates, for example, from a gasolines reforming process. The benzene level of this aromatic hydrocarbons cut, which can customarily vary between 0.1% and 10% by volume is, in the present example, equal to 2.6% by volume.

For each of the seven series of fuel formulations, formulated such that the fuel thus produced complies with the specifications in force, the Applicant introduced a determined quantity of the cycloparaffinic base B3. Thus the levels of the latter base vary in the fuels from 0% to 5% by volume (Table 1), 10% to 15% by volume (Table 2), 20% to 25% by volume (Table 3), while being equal to 30% by volume in Table 4.

Within each series of formulations, i.e. for a defined level of the cycloparaffinic base B3, the Applicant determined the range of formulations in which the fuels thus formulated comply with the specifications in force for Avgas 100LL or come very close to these. Moreover, the Applicant calculated for each fuel thus produced (C1 to C27), the ratio R=(B1+B2)/B13 corresponding to the ratio of the sum of the quantities by volume of the isoparaffinic hydrocarbons cuts (B1+B2) to the quantity by volume of the cycloparaffinic cut (B3), and also calculated, for these same formulations C1 to C27, the ratio K=B1/B2, i.e. the ratio of the quantity by volume of the hydrocarbons cut containing 6 to 9 carbon atoms (B1) to the quantity by volume of the hydrocarbons cut containing 4 or 5 carbon atoms (B2), these two hydrocarbons cuts being introduced into the fuels produced according to the invention.

The chief characteristics of the fuels thus formulated are shown in Tables 1 to 4, the other specifications complying with the standard D910-00. The quantities of lead introduced into each fuel produced comply with said standard, i.e. 0.56 g/l, measured according to the standard ASTM D3341 or ASTM D5059.

Tables 1 to 4 show that the fuels C5 to C27 make it possible to meet the Avgas 100 LL specifications in force when the levels of cycloparaffinic base B3 vary from 5% to 30% by volume. They also show, for these same fuels, that these specifications are also met when the level of aromatic base varies from 0% to approximately 25% by volume. This makes it possible to propose fuels C5, C6, C9, C13, C17, C21, C25, C26 and C27 with very low levels of aromatic compounds (less than 5% by volume) and in particular benzene (less than 0.1% volume), or with reduced levels of these said molecules for C7, C10, C14, C18, C22, C23 and C24, since the levels of aromatic compounds and benzene are respectively less than 10% by volume and less than 0.2% by volume.

For these formulations of fuels with very low, or reduced, levels of aromatic and benzene, the level of isoparaffinic base B1 introduced is greater than 40% by volume and preferably greater than 43% by volume.

On the other hand, when there is no cycloparaffinic cut (B3) in the fuels (Table 1: fuels C1 to C4), the levels of aromatic compounds and benzene are respectively 21.7% and 0.7% by volume for a formulation normally used in the sector for this type of fuel. The absence from the fuel C1 of cycloparaffinic (B3) and aromatic (B4) bases does not allow it to comply with the Avgas 100LL specifications, the F4 and 10% distilled characteristics being off-specification. It must also be noted that, in the case of fuel C1, the high proportion of the isoparaffinic base (B1), which is greater than 90% by volume, makes this fuel economically disadvantageous, this latter base generally having a relatively high production cost.

Tables 1 to 4 teach that the fuels formulated with a cycloparaffinic base comply with the Avgas 100 LL specifications in force today, when at least 5.0% by volume and preferably at least 10.0% by volume of a hydrocarbons cut essentially comprising 90% by mass cyclohexanes is introduced into said fuels, when the ratio R is greater than 2.0 and preferably comprised between 2.3 and 19.0 and when the ratio K is greater than 2.0, and preferably comprised between 2.3 and 10.6.

The fuels thus produced according to the invention have various advantages:

- they have a high octane number, thus corresponding to the F4 and MON octane number specifications of the aviation gasoline Avgas100LL, without requiring supplementary additions of, for example oxygenated, additives other than those normally used and allowed;
- they are kind to the environment, as they contain less than 10% by volume of aromatic compounds and in particular less than 0.2% by volume of benzene, and preferably less than 5% by volume of aromatic compounds and in particular less than 0.1% by volume of benzene, thus making the fuels more favourable for their common use by consumers;

they are less expensive to produce, as they do not require any additional treatment stages, for example to reduce the benzene or increase the octane number;

they make it possible to reduce the specific severity of operation of catalytic reforming units;

finally, they are compatible with other equivalent hydrocarbons.

The invention claimed is:

1. A fuel for feeding spark ignition engines, in particular those fitted in aircraft, having an F4 octane number at least equal to 130 and a reduced level of aromatic compounds, said fuel containing greater than 40% by volume of a first hydrocarbons base (B1) essentially constituted by isoparaffins comprising 6 to 9 carbon atoms, wherein a level of isoparaffins containing eight carbon atoms in the isoparaffinic hydrocarbons cut (B1) is greater than 70% by mass, and a second hydrocarbons base (B2) also constituted by isoparaffins comprising 4 or 5 carbon atoms wherein the fuel contains at least 5.0% by volume of a hydrocarbons base (B3) essentially composed of cyclohexane, and in that a ratio R of the quantities by volume (B1+B2)/B3 is greater than 2.0, wherein the level of aromatic compounds of the fuel is less than 10% by volume.

2. A fuel according to claim 1, wherein the ratio R of the quantities by volume (B1+B2)/B3 is between 2.3 and 19.0.

3. A fuel according to claim 2, wherein a ratio K of the quantities by volume B1/B2 is greater than 2.0.

4. A fuel according to claim 3, wherein the ratio K of the quantities by volume B1/B2 is comprised between 2.3 and 10.6.

5. A fuel according to claim 2, wherein the second isoparaffinic hydrocarbons cut (B2) is essentially constituted by isoparaffins with five carbon atoms.

6. A fuel according to claim 1, wherein a ratio K of the quantities by volume B1/B2 is greater than 2.0.

7. A fuel according to claim 6, wherein the ratio K of the quantities by volume B1/B2 is comprised between 2.3 and 10.6.

8. A fuel according to claim 6, wherein the second isoparaffinic hydrocarbons cut (B2) is essentially constituted by isoparaffins with five carbon atoms.

9. A fuel according to claim 1, wherein the level of cyclohexanes in the cut (B3) is greater than 80% by mass.

10. A fuel according to claim 1, wherein the level of cyclohexanes in the hydrocarbons base (B3) is greater than 90% by mass.

11. A fuel according to claim 1, wherein the level in the fuel of the isoparaffinic hydrocarbons cut (B1) is greater than 43% by volume.

12. A fuel according to claim 11, wherein the isoparaffinic hydrocarbons containing eight carbon atoms are isooctane.

13. A fuel according to claim 1, wherein the isoparaffinic hydrocarbons containing eight carbon atoms are isooctane.

14. A fuel according to claim 1, wherein the level of isooctanes in the isoparaffinic hydrocarbons cut (B1) with eight carbon atoms is greater than 75% by mass.

15. A fuel according to claim 1, wherein the second isoparaffinic hydrocarbons cut (B2) is essentially constituted by isoparaffins with five carbon atoms.

16. A fuel according to claim 15, wherein the isoparaffinic hydrocarbons containing five carbon atoms are isopentane.

17. A fuel according to claim 16, wherein the level of isopentane in the isoparaffinic hydrocarbons cut (B2) with five carbon atoms is greater than 85% by mass.

18. A fuel according to claim 17, wherein the level of isopentane in the isoparaffinic hydrocarbons cut (B2) with five carbon atoms is greater than 90% by mass.

19. A fuel according to claim 1, wherein the isoparaffinic hydrocarbons cut (B2) is essentially constituted by a mixture of n-butane and isobutane.

20. A fuel according to claim 1, wherein a benzene content of the fuel is less than 0.2% by volume.

21. A fuel according to claim 20, wherein the benzene content of the fuel is less than 0.1% by volume.

22. A fuel according to claim 1, wherein said fuel contains at least 10.0% by volume, of said hydrocarbons base (B3) essentially composed of cyclohexane.

23. A fuel according to claim 1, wherein the fuel's level of aromatic compounds is less than 5% by volume.

24. A fuel according to claim 1 further comprising other hydrocarbons and additives customary for this type of fuel.

25. A method comprising providing the fuel according to claim 1, to run ignition engines on aircraft.

26. A method comprising providing the fuel according to claim 1, to run spark ignition engines of competition or similar vehicles.

27. A method comprising providing the fuel according to claim 1 to run a fuel treatment unit, such as a reformer, coupled to a fuel cell.

* * * * *

UNITED STATES PATENT AND TRADEMARK OFFICE

CERTIFICATE OF CORRECTION

PATENT NO. : 7,918,990 B2
APPLICATION NO. : 10/550702
DATED : April 5, 2011
INVENTOR(S) : Seyfried et al.

It is certified that error appears in the above-identified patent and that said Letters Patent is hereby corrected as shown below:

Title Page, insert:

--(73) ASSIGNEE: TOTAL FRANCE, Puteaux, France--

Signed and Sealed this
Twenty-eighth Day of August, 2012

David J. Kappos

David J. Kappos
*Director of the United States Patent and Trademark Office*